US008926367B2

(12) United States Patent
Hsu

(10) Patent No.: US 8,926,367 B2
(45) Date of Patent: Jan. 6, 2015

(54) ELECTRICAL CONNECTOR WITH DETECT FUNCTION

(71) Applicant: Hon Hai Precision Industry Co., Ltd., New Taipei (TW)

(72) Inventor: Kuo-Chun Hsu, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 9 days.

(21) Appl. No.: 13/909,085

(22) Filed: Jun. 4, 2013

(65) Prior Publication Data

US 2013/0337685 A1 Dec. 19, 2013

(30) Foreign Application Priority Data

Jun. 14, 2012 (TW) ..... 101211488 A

(51) Int. Cl.
*H01R 13/648* (2006.01)

(52) U.S. Cl.
USPC ..... 439/607.35; 439/607.4

(58) Field of Classification Search
USPC ..... 439/607.01
See application file for complete search history.

(56) References Cited

U.S. PATENT DOCUMENTS

| | | | | |
|---|---|---|---|---|
| 7,632,156 | B1 * | 12/2009 | Chiang | 439/682 |
| 8,113,865 | B1 * | 2/2012 | Yang et al. | 439/353 |
| 8,262,414 | B1 * | 9/2012 | Li et al. | 439/607.35 |
| 8,382,519 | B2 * | 2/2013 | Lin et al. | 439/607.01 |
| 8,801,462 | B2 * | 8/2014 | Tsai | 439/607.01 |

FOREIGN PATENT DOCUMENTS

| | | |
|---|---|---|
| CN | 201674022 | 12/2010 |

* cited by examiner

*Primary Examiner* — Hien Vu
(74) *Attorney, Agent, or Firm* — Wei Te Chung; Ming Chieh Chang

(57) ABSTRACT

An electrical connector includes an insulative housing, a plurality of first and second terminals. The insulative housing includes a rear base portion and a front tongue portion. Each first terminal defines a first retained portion retaining in the insulative housing, a first contacting portion at a second mating surface of the tongue portion, and a first solder portion extending from the insulative housing. Each second terminal defines a second connecting portion retaining in the insulative housing, a second contacting portion at a second mating surface of the tongue portion, and a second solder portion. Wherein one terminal of first terminals located adjacent to a lateral surface of the tongue portion defines an elastic contacting arm integrally extends from the first retained portion. The contacting arm defines an outward-tip projecting outwards from the lateral side of the tongue portion so as to provide a detect pin without any soldering portion.

8 Claims, 5 Drawing Sheets

ELECTRICAL CONNECTOR WITH DETECT FUNCTION

BACKGROUND OF THE INVENTION

1. Field of the Invention

The present invention relates to an electrical connector, and more particularly to an electrical connector with a detecting pin integrated with a grounding terminal.

2. Description of the Related Art

Universal Serial Bus interface as a standard input/output interface, has been widely used in the design of many electronic devices, such as personal computers, mobile phones, digital cameras, audio players and other electronic products. With the development of modern electronic technology, the PCs can make external systems, such as mobile phones, charged without boot situation. Wherein conventional USB 2.0 connectors can make the external systems detected and charged by increasing independence switch terminals. When the switch terminal detected the insertion of the mating connector, the notebook will begin to supply electricity so as to reduce the power consumption of the notebook.

However, a conventional USB 3.0 comprises an insulative housing, a plurality of first and second terminals retained in the insulative housing and a metal shell shielded the insulative housing. The first terminals are the terminals of USB 2.0 connector, and the first and second terminals are together forming the terminals of USB 3.0 connector. The USB 3.0 can also have the same detection function by increasing independence switch terminals, however, it will make the structure of USB 3.0 connector become complicated so as to manufacture more difficult and increase the manufacturing cost.

Therefore, an improved electrical connector is desired to overcome the disadvantages of the related arts.

BRIEF SUMMARY OF THE INVENTION

An object of the present invention is to provide an electrical connector which is manufactured simple and having detection function.

In order to achieve above-mentioned object, an electrical connector includes an insulative housing, a plurality of first and second terminals. The insulative housing includes a rear base portion and a front tongue portion. Each first terminal defines a first retained portion retaining in the insulative housing, a first contacting portion at a second mating surface of the tongue portion, and a first solder portion extending from the insulative housing. Each second terminal defines a second connecting portion retaining in the insulative housing, a second contacting portion at a second mating surface of the tongue portion, and a second solder portion extending from the insulative housing. Wherein one terminal of the first terminals located adjacent to a lateral surface of the tongue portion defines an elastic contacting arm integrally extends from the first retained portion thereof The contacting arm defines an outward-tip projecting outwards from the lateral side of the tongue portion so as to provide a detect pin without any soldering portion.

Other objects, advantages and novel features of the invention will become more apparent from the following detailed description of the present embodiment when taken in conjunction with the accompanying drawings.

DESCRIPTION OF PREFERRED EMBODIMENT OF THE INVENTION

Figure 1:
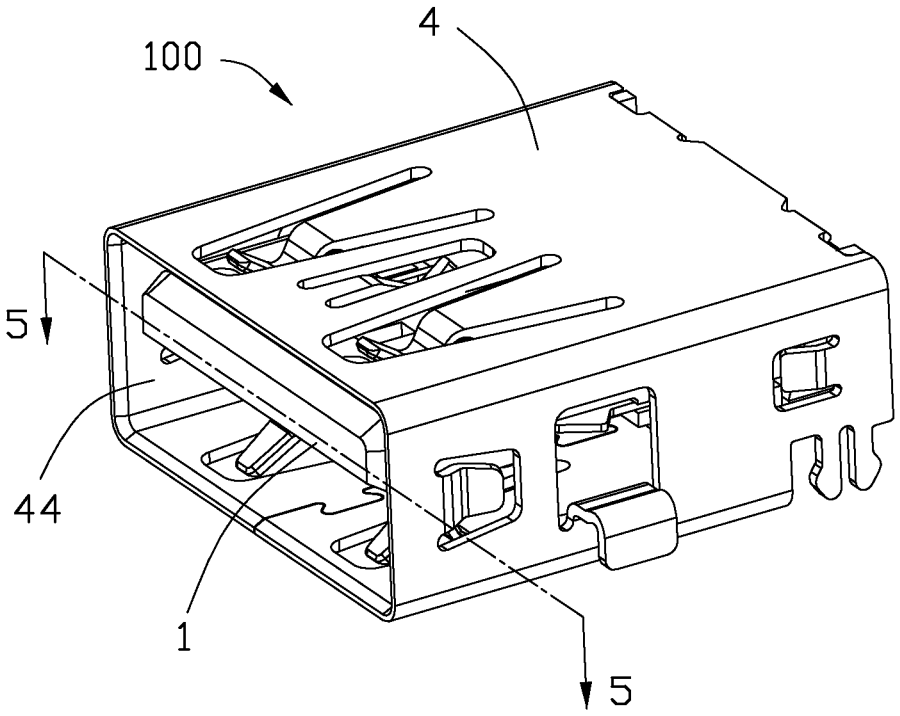
FIG. 1 is a perspective view of an electrical connector of an embodiment in accordance with the present invention.
Figure 2:
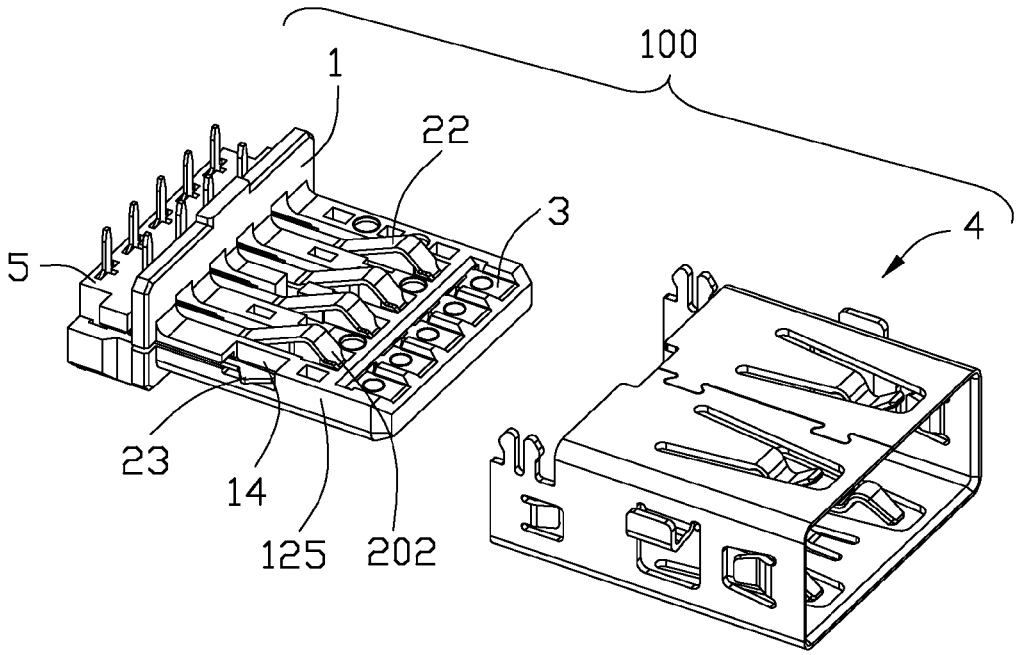
FIG. 2 is a partially exploded perspective view of the electrical connector shown in FIG. 1.

Reference will now be made to the drawing figures to describe a preferred embodiment of the present invention in detail. Referring to FIGS. 1 to 2, an electrical connector comprises an insulative housing 1, a plurality of first terminals 2 and second terminals 3 loaded in the insulative housing 1, a metal shell 4 shielding the insulative housing 1 and a positioning member 5 retained in the insulative housing 1.

Figure 3:
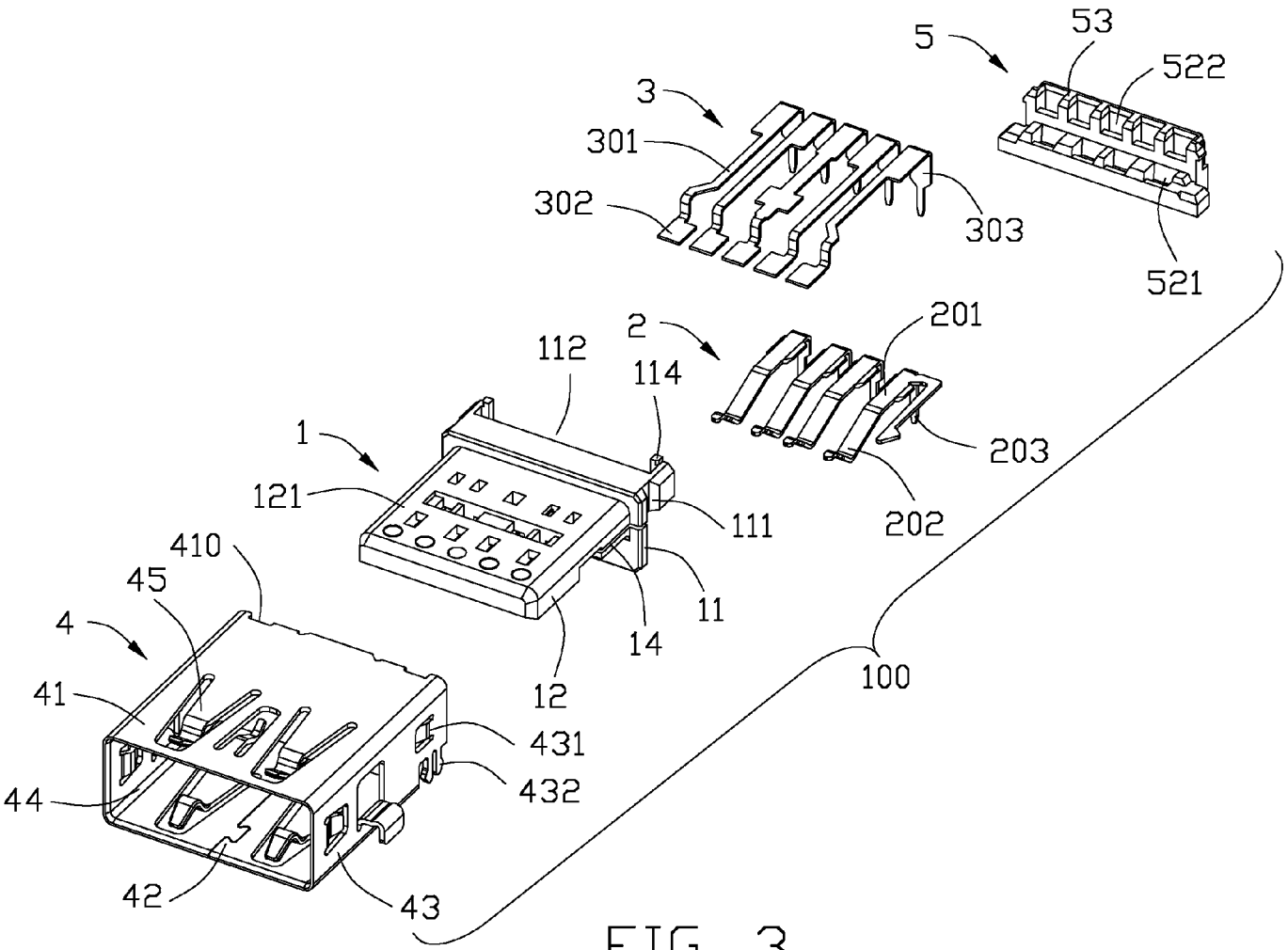
FIG. 3 is an exploded perspective view of the electrical connector shown in FIG. 1.
Figure 4:
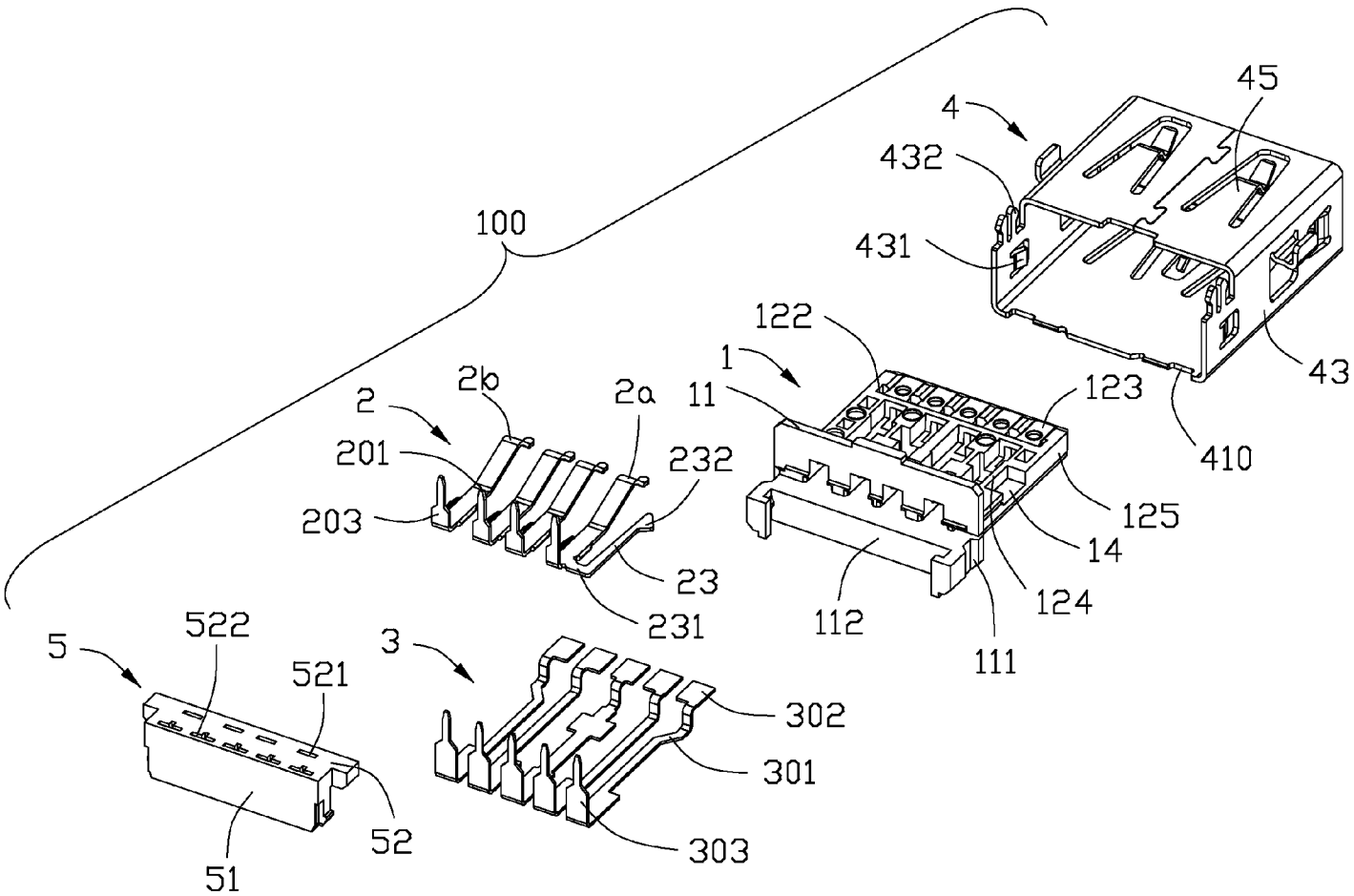
FIG. 4 is another exploded perspective view of the electrical connector shown in FIG. 1.

Referring to FIGS. 3 to 4, the insulative housing 1 comprises a base portion 11 and a tongue portion 12 projecting forwardly from the base portion 11. The base portion 11 defines a pair of vertical retaining slots 111 at opposite sides thereof, a receiving groove 112 with a pair of end portions 114 on both ends of the receiving groove 112 at the rear end thereof The tongue portion 12 defines a first mating surface 121 and a second mating surface 122 opposite to the first mating surface in a vertical direction thereof, wherein the second mating surface 122 defines a plurality of terminal passageways 124.

In this present embodiment, the group of the first terminals are intended to transmit USB 2.0 signal, the group of the second terminals with the first terminals together are intended to transmit USB 3.0 signal.

The group of the first terminals 2 include four first terminals juxtaposed with each other. Each first terminal 2 defines a first retained portion 201 retained in the insulative housing 1, an elastic first contacting portion 202 extending forwardly from the front of the first retained portion 201 and a solder portion 203 bent downwardly and extending from the rear end of the first retained portion 201. The first retained portions 201 are accommodated in the terminal passageways 124, the first contacting portions 202 protruding downwardly from the second mating surface of the tongue portion 12, and the solder portions 203 extending out of the insulative housing 1. One first terminals 2*a*, a grounding terminal of the first terminals 2 further defines an elastic contacting arm 23 which is integrally extending from an outer lateral side of the retained portion of the grounding terminal, and a slot 14 to accommodate the elastic contacting arm 23 is defined at one lateral side 125 between the first and the second mating surfaces of the tongue portion 12. The contacting arm 23 is disposed substantially parallel to the retained portion and connecting with the retained portion with a lateral connecting portion 231. The contacting arm 23 has an outward-tip 232 projecting from the lateral side 125 in an original statue without any insertion of a mating connector. The outward-tip 232 is located behind the contacting portion 202 of the first terminals. The lateral connecting portion 231 is located adjacent to a rear end of the retained portion. The contacting arm is functioned as a detecting pin.

The group of second terminals 3 include five second terminals juxtaposed with each other and each second terminal 3 defines a second retained portion 301, a plate-shaped second contacting portion 302 extending from a front end of the second retained portion 301 and located in front of the first contacting portion 202 and a second solder portion 303 bending and extending from a rear end of the second retained portion 301. The second terminals 3 are integrally injection molded in the insulative housing 1, wherein the second contacting portion 302 are retained in the recessed portion 123 on the second mating surface of the tongue portion 12, the second retained portions 301 are embedded in the insulative housing 1 and the second solder portions 303 extending from the insulative housing 1.

The metal shell 4 comprises a first wall 41 facing to the first mating surface 121 of the tongue portion 12, a second wall 42 facing to the second mating surface 122 of the tongue portion 12 and two side walls 43 connecting with the first and second walls. The first wall surface 41 defines a pair of recesses 410 along a rear edge thereof in which the end portions 114 of the insulative housing 1 is held so that the metal shell 4 is positioned on the insulative housing 1. Each side wall 43 of the metal shell 4 includes a hook portion 431 clamped the retaining slot 111 of the insulative housing 1 and a welding pin 432 extending downwardly and soldered to a circuit board. A receiving space 44 is formed for receiving a mating connector among the first wall 41, the second wall and two side walls 43 surrounding the tongue portion 12, the four walls of the metal shell 4 define inward tabs 45 projecting elastically into the receiving space 44 for clamping the mating connector.

The positioning member 5 is assembled to the rear side of the insulative housing 1 and comprises a rear surface 51, an upper wall 53 and a lower wall 52 and two rows of through-holes 522, i.e. a first through-hole 521 and a second through-hole 522, run through the upper wall 52 and the lower wall 53.

Figure 5:
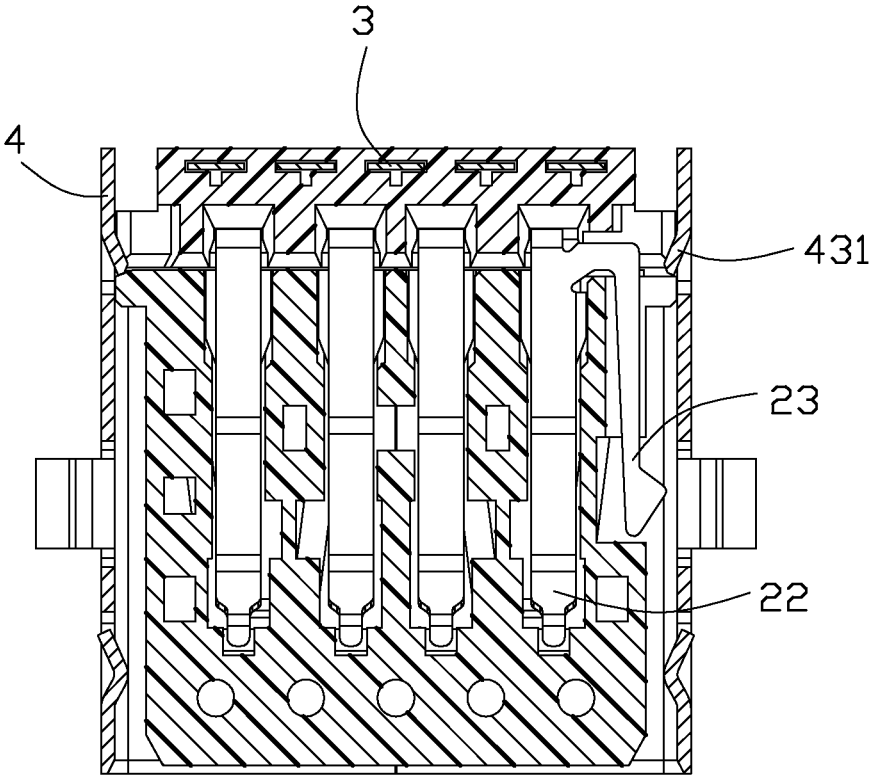
FIG. 5 is a cross-sectional view of the electrical connector shown in FIG. 1 along line 5-5.

Referring to FIGS. 3 to 5, the assembly process of the electrical connector in the present embodiment as follow. The second terminals 3 are integrally molded in the insulative housing 1. Then the first terminals 2 are inserted into the insulative housing 1 in a rear-to-front direction. The positioning member 5 is inserted into the receiving groove 112, wherein the first solder portions 203 of the first terminals 2 are fixed in the first through-holes 521 and the second solder portions 303 of the second terminals 3 are fixed in the second through-holes 522 so that the positioning member 5 is fixed on the insulative housing 1. The metal shell 4 covers the insulative housing 1 and the hook portions 431 of the metal member 4 are clamped the retaining slot 111.

In summary, the detecting pin in a form of an elastic contacting arm 23 integrally from a grounding terminal 22*a* of the first terminals 2, do not need a soldering portion as usually construed to be welded to the printed circuit board. Further, the elastic contacting arm 23 laterally extends from the lateral side of the tongue portion 12, which is not interfere with the second terminals of USB 3.0. Alternatively, the contacting arm can be defined at another outermost terminal, i.e. the power terminal 2*b*.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. An electrical connector, comprising:

an insulative housing comprising a rear base portion and a front tongue portion;

a group of first terminals, each first terminal comprising a first retained portion retaining in the insulative housing, a first contacting portion at a second mating surface of the tongue portion, and a first solder portion extending from the insulative housing;

a group of second terminals, each second terminal comprising a second connecting portion retaining in the insulative housing, a second contacting portion at the second mating surface of the tongue portion, and a second solder portion extending from the insulative housing;

a metal shell surrounding the tongue portion;

wherein one terminal of the group of first terminals located adjacent to a lateral side of the tongue portion defines an elastic contacting arm integrally extends from and substantially parallel with the first retained portion thereof, the contacting arm defines an outward-tip projecting outwards from the lateral side of the tongue portion so as to provide a detect pin without any soldering portion;

wherein the tongue portion defines a first mating surface opposite to the second mating surface in a vertical direction thereof, the contacting arm extends outwardly parallel to the second mating surface;

wherein the tongue portion defines a slot opening through the lateral side between the first and second mating surfaces thereof, the contacting arm is accommodated in the slot;

wherein the outward-tip is located behind the first contacting portion of the first terminals in a mating direction;

wherein the contacting arm is integrally connecting with the first retained portion through a lateral connecting portion, the connecting portion is located adjacent to a rear end of the first retained portion;

wherein the lateral connecting portion is retained in the base portion and located at a same plane to the first retained portion.

2. The electrical connector as described in claim 1, wherein the metal shell defines a plurality of tabs projecting elastically into the receiving space.

3. The electrical connector as described in claim 1, wherein a pair of retaining slots located on both sides of the base portion of the insulative housing, and a pair of hook portions located on both sides of the side walls of the metal shell for clamping the tabs.

4. The electrical connector as described in claim 3, wherein the first solder portions are fixed in the first through-holes and the second solder portions are fixed in the second through-holes so that the positioning member is fixed to the insulative housing.

5. The electrical connector as described in claim 1, wherein electrical connector further comprises a positioning member, the positioning member includes an upper wall, a lower wall and first and second through-holes run through the upper wall and lower wall, the first and second through-holes are arranged to two rows.

6. An electrical connector for use with a plug, comprising:

an insulative housing defining a mating tongue enclosed in a metallic shell to communicate with an exterior in a first direction, said shell including a rectangular tubular body defined by two opposite main walls and two opposite side walls; and a set of terminals disposed in the housing with resilient contacting sections exposed upon the mating tongue and deflectable in a second direction perpendicular to said first direction;

wherein one outermost terminal of said terminals is further unitarily formed with a resilient contacting arm located along a side edge of said mating tongue and substantially parallel with said one outermost terminal, and inwardly deflectable in either the second direction or a third direction perpendicular to both said first direction and said second direction;

wherein said mating tongue defines a slot to allow the contacting arm to be moveable therein;

wherein said outermost terminal is a grounding terminal to have said contacting arm adapted to be electrically connected to the metallic shell via a metallic shield of said plug when said plug is inserted into the metallic shell;

wherein said outermost terminal defines a U-shaped structure, viewed in the second direction, to respectively connect to said contacting arm and the corresponding contacting section, respectively;

wherein another set of terminals with stationary contacting sections exposed upon the mating tongue, wherein said another set of terminals are alternately arranged with said set of terminals in the third direction in a staggered manner; and wherein said contacting arm directly faces outwardly toward one of said side walls in said third direction and is deflectable in said third direction.

7. The electrical connector as claimed in claim 6, wherein a centerline of said U-shaped structure of said outermost terminal is aligned with that of a neighboring one of said another set of terminals in said first direction.

8. The electrical connector as claimed in claim 7, wherein a tail of said outermost terminal is offset from the centerline of said U-shaped structure while that of the neighboring one of said another set of terminals is roughly aligned with said centerline of the U-shaped structure.

* * * * *